US008169145B2

(12) United States Patent
Boy et al.

(10) Patent No.: US 8,169,145 B2
(45) Date of Patent: May 1, 2012

(54) SPARK-DISCHARGE GAP FOR POWER SYSTEM PROTECTION DEVICE

(75) Inventors: Juergen Boy, Berlin (DE); Winfried Voelkner, Berlin (DE)

(73) Assignee: EPCOS AG, Munich (DE)

( * ) Notice: Subject to any disclaimer, the term of this patent is extended or adjusted under 35 U.S.C. 154(b) by 243 days.

(21) Appl. No.: 11/997,425

(22) PCT Filed: Aug. 2, 2006

(86) PCT No.: PCT/DE2006/001348

§ 371 (c)(1),
(2), (4) Date: Apr. 24, 2008

(87) PCT Pub. No.: WO2007/014556

PCT Pub. Date: Feb. 8, 2007

(65) Prior Publication Data

US 2008/0218082 A1 Sep. 11, 2008

(30) Foreign Application Priority Data

Aug. 2, 2005 (DE) ..... 10 2005 036 265

(51) Int. Cl.

| | |
|---|---|
| ***H01J 17/04*** | (2012.01) |
| ***H01J 61/04*** | (2006.01) |
| *H01J 17/26* | (2012.01) |
| *H01J 61/28* | (2006.01) |

(52) U.S. Cl. ..... 313/631; 313/231.11; 313/231.21; 313/621; 361/117; 361/118; 361/119; 361/120

(58) Field of Classification Search ..... 313/621, 313/635–63, 631, 231.11, 231.21, 325; 361/117–120
See application file for complete search history.

(56) References Cited

U.S. PATENT DOCUMENTS

| | | | | | |
|---|---|---|---|---|---|
| 3,454,811 | A | * | 7/1969 | Scudner, Jr. | 313/631 |
| 3,649,874 | A | * | 3/1972 | Peche | 361/120 |
| 3,739,230 | A | * | 6/1973 | Lange | 361/120 |
| 3,775,642 | A | * | 11/1973 | Lange | 361/120 |
| 3,780,350 | A | * | 12/1973 | Sanger et al. | 361/118 |
| 3,878,423 | A | * | 4/1975 | Hill et al. | 313/267 |
| 3,995,183 | A | * | 11/1976 | Lechner et al. | 313/124 |
| 4,084,208 | A | * | 4/1978 | Bazarian et al. | 361/120 |
| 4,091,436 | A | * | 5/1978 | Lange et al. | 361/120 |
| 4,123,682 | A | * | 10/1978 | Lange et al. | 313/54 |
| 4,266,260 | A | * | 5/1981 | Lange et al. | 361/120 |
| 4,345,293 | A | * | 8/1982 | Hasse et al. | 361/117 |
| 4,362,962 | A | * | 12/1982 | Lange | 313/331 |
| 4,433,354 | A | * | 2/1984 | Lange et al. | 361/120 |

(Continued)

FOREIGN PATENT DOCUMENTS

CN 1124540 6/1996

(Continued)

OTHER PUBLICATIONS

Dehngap B NH, Dehn + Soene, Hauptkatalog, 2004, p. 55.

(Continued)

*Primary Examiner* — Anne Hines
*Assistant Examiner* — Jose M Diaz
(74) *Attorney, Agent, or Firm* — Fish & Richardson P.C.

(57) ABSTRACT

A spark gap includes two terminal electrodes enveloping a cavity. The cavity includes an electrical discharge space between the two terminal electrodes. The spark gap also includes an electrical insulator between the two terminal electrodes.

18 Claims, 4 Drawing Sheets

U.S. PATENT DOCUMENTS

| | | | | | |
|---|---|---|---|---|---|
| 4,475,055 | A | * | 10/1984 | Boettcher | 313/54 |
| 4,491,893 | A | * | 1/1985 | Toda | 313/318.02 |
| 4,493,003 | A | * | 1/1985 | Mickelson et al. | 361/119 |
| 4,493,004 | A | * | 1/1985 | Lange et al. | 361/120 |
| 4,493,006 | A | * | 1/1985 | Lange et al. | 361/124 |
| 4,546,402 | A | * | 10/1985 | deSouza et al. | 361/120 |
| 4,578,733 | A | * | 3/1986 | Shigemori et al. | 361/120 |
| 4,583,147 | A | * | 4/1986 | Boy et al. | 361/120 |
| 4,603,368 | A | * | 7/1986 | Pagliuca | 361/119 |
| 4,680,665 | A | * | 7/1987 | Bonnesen et al. | 361/120 |
| 4,707,762 | A | * | 11/1987 | Yapoujian | 361/124 |
| 4,739,439 | A | | 4/1988 | Boy | |
| 4,769,736 | A | | 9/1988 | Boy | |
| 4,831,485 | A | * | 5/1989 | Boy et al. | 361/120 |
| 4,878,146 | A | * | 10/1989 | Kaczmarek | 361/119 |
| 4,908,730 | A | * | 3/1990 | Westrom | 361/120 |
| 4,967,303 | A | * | 10/1990 | Yuhasz | 361/23 |
| 5,103,135 | A | * | 4/1992 | Lange et al. | 313/623 |
| 5,142,194 | A | | 8/1992 | Jacubeit et al. | |
| 5,352,953 | A | * | 10/1994 | Wakabayashi et al. | 313/631 |
| 5,491,381 | A | * | 2/1996 | Idei et al. | 313/589 |
| 5,633,777 | A | * | 5/1997 | Boy et al. | 361/117 |
| 5,671,114 | A | | 9/1997 | Daeumer et al. | |
| 5,892,648 | A | * | 4/1999 | Bobert et al. | 361/120 |
| 6,194,820 | B1 | | 2/2001 | Machida | |
| 6,326,724 | B1 | * | 12/2001 | Daumer et al. | 313/484 |
| 6,362,945 | B1 | * | 3/2002 | Bobert et al. | 361/120 |
| 6,570,090 | B1 | * | 5/2003 | Boy et al. | 174/50.58 |
| 6,617,804 | B2 | * | 9/2003 | Machida | 315/209 M |
| 7,053,536 | B1 | * | 5/2006 | Boman et al. | 313/231.11 |
| 7,116,049 | B2 | * | 10/2006 | Machida | 313/637 |
| 7,643,265 | B2 | * | 1/2010 | Loader et al. | 361/120 |
| 2006/0209485 | A1 | * | 9/2006 | Imai et al. | 361/120 |

FOREIGN PATENT DOCUMENTS

| | | |
|---|---|---|
| DE | 764293 | 6/1953 |
| DE | 3031055 | 4/1982 |
| DE | 8611043 | 11/1987 |
| DE | 3621254 | 1/1988 |
| DE | 4318994 | 12/1994 |
| EP | 0251010 | 6/1987 |
| EP | 0408003 | 7/1990 |
| EP | 1102371 | 5/2001 |
| JP | 59-033779 | 2/1984 |
| JP | 61-281489 | 12/1986 |
| JP | 62-256394 | 11/1987 |
| JP | 63-013290 | 1/1988 |
| JP | 2-236984 | 9/1990 |
| JP | 3-121694 | 5/1991 |
| JP | 03121695 | 5/1991 |
| JP | 04065087 | 3/1992 |
| JP | 11-307047 | 11/1999 |
| JP | 11-339924 | 12/1999 |
| JP | 2001-052840 | 2/2001 |
| JP | 2005-063720 | 3/2005 |
| WO | WO94/28607 | 12/1994 |
| WO | WO 2004/017479 | 2/2004 |

OTHER PUBLICATIONS

Dehngap Maxi, Dehn + Soene, Hauptkatalog, 2004, p. 53.

Hakel HG100F-500, Gas discharge tube; www.hakel.com.

Hakel HG80F-500, Gas discharge tube; www.hakel.com.

Leutron SumPro-B-Tr, Leutronkatalog; Jan. 6, 2001, p. 21.

"Overcoming overvoltage", EPCOS Components, Apr. 2004, 2 pages.

International Search Report from corresponding PCT Application No. PCT/DE2006/001348, mailed Nov. 16, 2006, 4 pages.

International Preliminary Report on Patentability from corresponding PCT Application No. PCT/DE2006/001348, mailed Nov. 16, 2006, 6 pages.

Notification of Reasons for Refusal (type I office action), in JP Pat. Appl. No. 2008-524354, mailed Jun. 9, 2011, 11 pages.

* cited by examiner

SPARK-DISCHARGE GAP FOR POWER SYSTEM PROTECTION DEVICE

CROSS REFERENCE TO RELATED APPLICATIONS

Pursuant to 35 USC §120, this application claims the benefit of PCT/DE2006/001348 filed Aug. 2, 2006 which claims the benefit of German Patent Application No. 102005036265.6 filed Aug. 2, 2005. Each of these applications is incorporated by reference in its entirety.

FIELD OF THE INVENTION

A spark gap, in particular, for the protection of supply lines or AC power systems from the influence of lightning is described herein.

BACKGROUND

Spark gaps as protection elements against overvoltages are conventionally known. Thus, WO 2004/017479 A1 describes a hybrid overvoltage protection element, in which a varistor and an arrester are connected in parallel.

SUMMARY

Particularly in the devices of the power system protection, there is a need to improve the characteristics of such elements, particularly in regard to current-carrying capacity and extinguishing behavior. Air spark gaps with triggering devices are basically suitable for use with high currents and voltages, but they are cumbersome, expensive, and voluminous.

An improved spark gap, particularly with a compact design that is suitable for high current loads is described herein.

In a first embodiment, a spark gap is proposed with a cavity that is comprised of two terminal electrodes and an electrical insulator therebetween. The spark gap has a rod electrode, which projects into a tubular electrode, and cavity-side recesses and bulges of the terminal electrodes and a guide for the terminal electrodes on the inside wall of the insulator.

The implementation has an extremely compact spark gap structure and, at the same time, excellent overall characteristics. The terminal electrodes close off the insulator at the ends and together with the latter form the cavity. Bulges of the terminal electrodes extend into the cavity from the individual edge-side transition area of the terminal electrodes with the insulator.

In the production of this very compact spark gap, it is thus possible to adapt electrodes carrying the spark discharge very precisely to the gap and its bulges, both with regard to the materials used and also with regard to their connection to the terminal electrodes. In addition, it is possible to connect connecting bolts, provided as external connections of the spark gap, within the bulges with the terminals, in order to obtain an even more compact structure and a more optimized material adaptation.

The bulges of the terminal electrodes or the beads in the bulges permit, moreover, a precise and secure guidance of the terminal electrodes on the inside wall of the insulator. The terminal electrodes and the insulator can therefore even be adjusted very precisely, with respect to one another, in a miniaturized spark gap during installation. It is even possible to connect the terminal electrodes to the insulator when self-adjusted relative to one another.

In a second embodiment, a spark gap is provided with a cavity, which is enveloped by two terminal electrodes with an electrical insulator therebetween. The spark gap has a rod electrode protruding into a tubular electrode and reinforcement electrodes, each of which is connected to one of the terminal electrodes.

This implementation has an extremely compact spark gap structure and, at the same time, excellent overall characteristics. Thus, for example, the terminal electrodes are thin and produced from a highly conductive material. The terminal electrodes preferably have a low thermal capacity. The material combination of a rod and a tubular electrode, a terminal electrode, a reinforcement electrode, and perhaps connecting bolts connected to them externally makes possible the optimization of the spark gap with regard to its compactness and its electrical, thermal, and mechanical characteristics.

The shapes of the terminal electrodes and the reinforcement electrodes are preferably matched to one another. In this way, both a stable outside electrode and also a good heat removal are possible in the case of discharge.

Even if the spark gap does not have the necessary stability by means of the terminal electrodes alone, the reinforcement electrodes guarantee the stability and integrity of the spark gap, particularly if the reinforcement electrodes are made of a harder material than the terminal electrodes.

The individual elements of the claimed embodiments of the spark gap, optimized in their entirety, have, on the one hand, a compact overall shape and, on the other hand, have an influence particularly on improved thermal and electrical characteristics. Thus, the current-carrying capacity and the dynamic ignition conditions of the spark gap are improved.

The rod electrode as the first electrode and the tubular electrode as the second electrode are placed in the cavity of the insulator. The first and second electrodes interpenetrate and are spatially separate from one another. The second electrode lies between the insulator and the first electrode and is separate spatially from both. In this way, an arrangement with interpenetrating elements is produced, which is implemented in a simple manner.

Any electrode shape that in external appearance has the form of a rod or bar can be regarded as the rod electrode. This also includes tubes with at least one end flange. Likewise, a tubular electrode has the form of a closed or also partially interrupted tube. The terms "first electrode" and "rod electrode" are used as synonyms below, as are "second electrode" and "tubular electrode."

By means of the arrangement with interpenetrating elements, the rod electrode preferably meshes into the tubular electrode in such a way that the inside wall of the insulator, surrounding the electrodes, which is preferably tubular in shape, is partially shaded-off from the rod electrode by means of the tubular electrode.

A shading-off of the insulator from the rod-shaped electrode by means of the tubular electrode advantageously permits the maintenance of the structural integrity of the insulator, and perhaps, ignition aids placed thereon, for example, graphite lines, and the stability of the insulating characteristics of the insulator, when the spark gap is ignited.

The interior of the spark gap is preferably filled with gas, especially a gas mixture containing a noble gas. This, on the one hand, supports positively the extinguishing behavior of the spark gap and, on the other hand, provides for comparatively dynamic ignition conditions with a repeated igniting of the spark gap.

In accordance with another embodiment of the spark gap, the ends of one or both electrodes are beveled in the discharge space. It is hereby preferred that the ends have rounded or smoothed outside surfaces, so that local electrical field increases are avoided.

It is also advantageous if at least one of the electrodes has an activation composition. With the activation composition, it is possible to guarantee a higher alternating current-carrying capacity of the spark gap. This is specifically possible if the activation composition is placed on the free end of the rod electrode and/or on the bottom of the tubular electrode.

The terminal electrode, preferably with one mounted on each front side of the insulator, makes possible an electrical connection of the spark gap toward the outside. A terminal electrode is hereby connected with the rod or tubular electrode. The contacting of the electrodes is carried out in such a way that, on the one hand, each electrode is exactly positioned and, on the other hand, the currents that appear can be safely grounded.

For the formation of the interior of the spark gap, which is preferably hermetically sealed-off—that is, gasproof to the outside—the terminal electrodes can completely cover the front sides of the insulator.

The two implementations can be combined in a particularly advantageous manner.

The individual elements of the claimed implementations of the spark gap, which are optimized in their entirety, result in a compact design on the one hand, and have a specific influence on improved thermal and electrical characteristics, on the other. Thus, the current-carrying capacity and the dynamic ignition conditions of the spark gap are improved.

The invention is explained below in more detail with the aid of the embodiment examples and the drawing.

DETAILED DESCRIPTION

Figure 1:
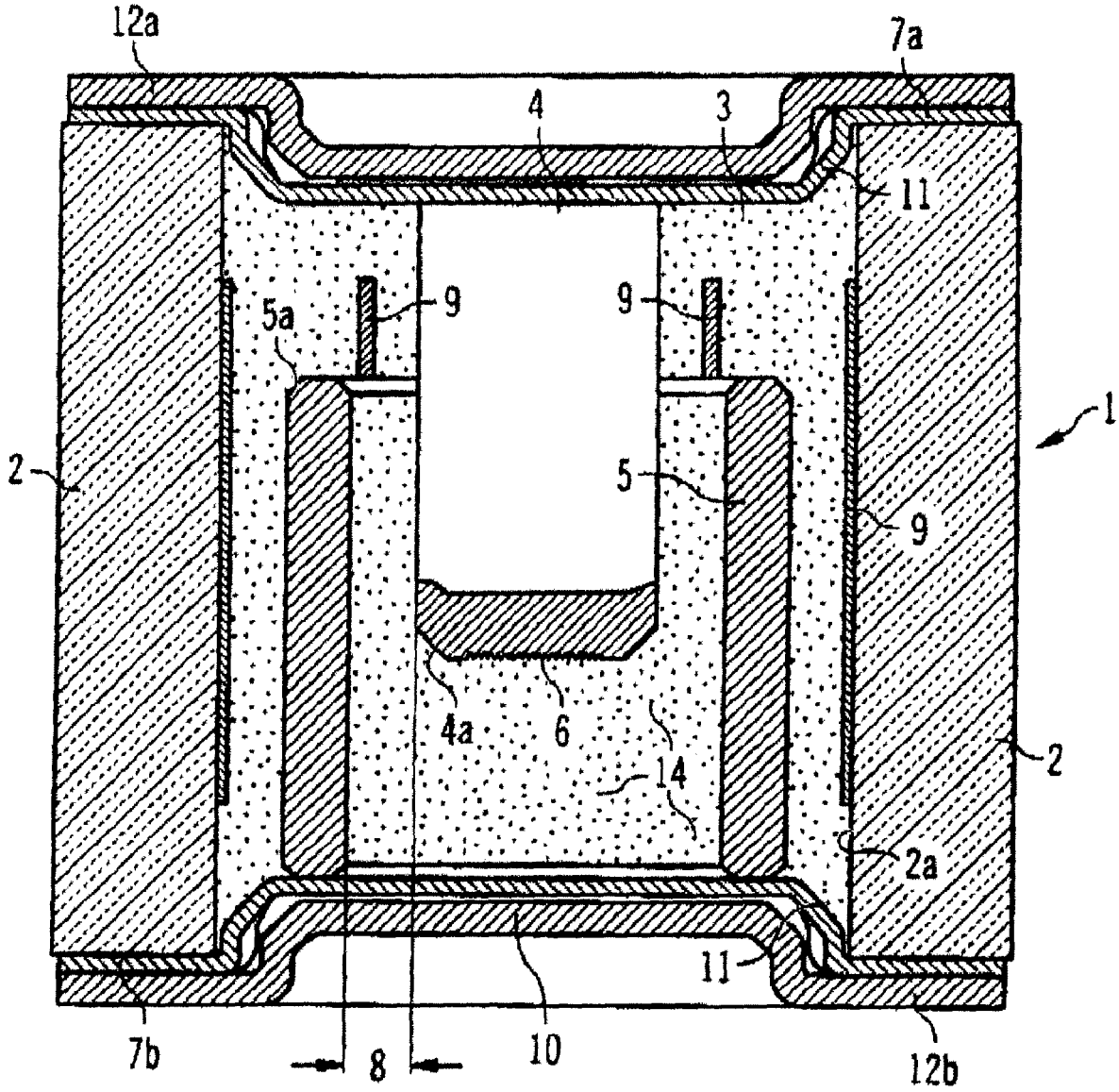
FIG. 1 shows a section through a first spark gap.

FIG. 1 shows a spark gap, in particular, a high-current spark gap, which contains a tubular insulator 2, especially made of ceramics. On the front side, the spark gap has terminal electrodes 7*a* and 7*b*. The terminal electrodes have cavity-side bulges, which are formed in the shape of a bowl, as in the embodiment of FIG. 1. They are used alone or, as shown in FIG. 1, in combination with reinforcement electrodes 12*a*, 12*b*, among other things, in the electrical connection to the network to be protected.

In the interior of the spark gap housing formed by the insulator and the terminal electrodes, there is a cavity 3, sealed off from the outside and filled with gas, preferably a gas mixture with noble gas. A first electrode 4 and a second electrode 5 are located in the cavity; they are affixed to one of the terminal electrodes 7*a* or 7*b* and are electroconductively connected to it. The first electrode 4, shown in partial section, preferably has the shape of a rod and the second electrode 5 preferably has the shape of a tube. The spark gap preferably has a height and a diameter of 25 mm to 35 mm, in particular, 30 mm.

The arrangement of the rod and tubular electrodes is selected in such a way that the rod electrode 4 projects or is introduced partially into the tubular electrode 5, with its free end. In this way, the tubular electrode 5 overlaps the rod electrode 4 partially and shades the rod electrode in this area of the inside wall of the insulator. This arrangement forms a configuration with interpenetrating elements.

The rod electrode and the tubular electrode are preferably positioned concentrically in their insertion area in such a way that a there is a distance or a space 8 between the outer surface of the rod electrode and the inside surface of the tubular electrode. The space 8 is used as the primary electrical discharge space, wherein secondary discharges can also take place in other spaces between the first and second electrodes 4 and 5.

The rod and the tubular electrodes have free ends lying in the cavity. The other end of the rod or tubular electrode is fixed to a terminal electrode 7*a* or 7*b*, in particular, by means of a hypereutectic hard soldering.

The edges 4*a* and 5*a* of preferably all ends of the electrodes are beveled or rounded-off, thereby avoiding increases in the electrical fields at these borders. In this way, a more uniform current discharge is attained in the cavity 3, particularly in the discharge space 8. Thus, avoiding local highly concentrated electromagnetic fields, and therefore the formation of accompanying temperature peaks as well. In particular, the current load for the rod and the tubular electrodes is reduced. Non-beveled electrodes, on the other hand, can bring about inadmissibly high current densities at the edges of the electrodes, which can lead to the undesired melting of the electrodes.

The preferred materials of the rod electrode and the tubular electrode are copper, iron, or a tungsten-copper mixture, or at least components of these materials. The electrodes can also contain materials which are different from one another, such as a rod electrode made of tungsten-copper and a tubular electrode made of copper. The expensive tungsten-copper has the least burn-up under surge-current loads, so that this material is also preferred for both electrodes. Electrodes made of iron or copper exhibit a higher burn-up, but are less expensive and therefore also advantageous.

Depending on the requirements, the nested construction of the first and second electrodes 4 and 5 permits the use of materials in the discharge area that are unsuitable as such, for a reliable ceramic-metal bond, such as iron or tungsten-copper.

A suitable ceramic for the insulator 2 is aluminum oxide ($Al_2O_3$). The insulator is dimensioned with a wall thickness of 4 mm to 6 mm, but preferably with a wall thickness of 5 mm, so as to control more reliably the enormous pressure wave during a surge current discharge in the interior of the spark gap, without bursting the insulator or forming cracks.

Ignition aids 9, for example, one or more ignition lines containing graphite, are applied to the inside wall 2*a* of the insulator; they ensure, above all, the good dynamic ignition behavior (for example, arc-through at <1500 V with a rise time of 5 kV/μsec). Furthermore, stable coefficient values, such as ignition voltage and insulation resistance, are ensured in this way. The ignition lines are effectively protected from burn-up by the shading effect of the tubular electrode.

An optimal ceramic-metal bond between the insulator 2 and the terminal electrode 7*a* or 7*b* exists if the thermal expansion coefficients of the two materials are equal or similar. With an insulator made of aluminum oxide, the ceramic-metal bond is preferably produced by an FeNi alloy or copper. With a composite electrode according to the embodiment example, the rod and the tubular electrodes are made of current-resistant materials and are fixed to the terminal electrode—for example, welded or hard-soldered. Therefore, the terminal electrode contains a material that can be bonded well to the material of the rod and tubular electrodes and also to that of the insulator. Composite electrodes, consisting of the first or second electrode, the terminal electrode, and, as in the embodiment example in FIG. 1, the reinforcement electrode with its optimized materials and forms, substantially contribute to a mechanical and electrical optimization of the spark gap.

The rod electrode and/or the tubular electrode are preferably provided with an activation composition, so as to reliably control a high AC load. In accordance with FIG. 1, an activation composition is placed on the free end of the rod electrode. Also, it is possible to apply an activation composition between the walls of the tubular electrode 5 on the inside of the terminal electrode 7*b* joined to the tubular electrode—that is, on the bottom of the tubular electrode. The activation composition is preferably a silicate coating, which is applied in depressions on the free end 4*a* of the rod electrode on the inside—for example, in the form of a waffle pattern.

It is particularly preferable to produce electrodes 7*a* and 7*b* from copper. They have several, preferably six, beads 11 on the circumference. They guide the terminal electrodes precisely and reliably in the ceramic tube 2, without the terminal electrodes having to fit completely and closely against the entire ceramic inside wall. Every terminal electrode is connected mechanically and electrically either to the rod or the tubular electrode, for example, by means of a hypereutectic hard soldering. It is also possible to use the bowl shape of the terminal electrodes themselves—that is, without beads—for guidance in the insulator.

The terminal electrodes are made of copper and can basically be thick enough to withstand the pressure and thermal stresses that arise. Comparatively thin terminal electrodes are possible by providing, in accordance with FIG. 1, additional reinforcement electrodes 12*a* and 12*b*, which contain, in particular, an iron-nickel alloy. The additional reinforcement electrodes 12*a*, 12*b* are hard-soldered to the corresponding terminal electrodes 7*a*, 7*b* with an approximately sandwiched structure and form composite electrodes. The reinforcement electrodes, for example, can be ca. 1 mm in thickness.

The reinforcement electrodes preferably have a shape that is complementary to the terminal electrodes so that they also have recesses and are adapted to the shape of the terminal electrodes. The reinforcement is provided with thin terminal electrodes, so as to prevent a bursting of the spark gap or a squeezing out of the terminal electrodes during surge current discharge.

Figure 4:
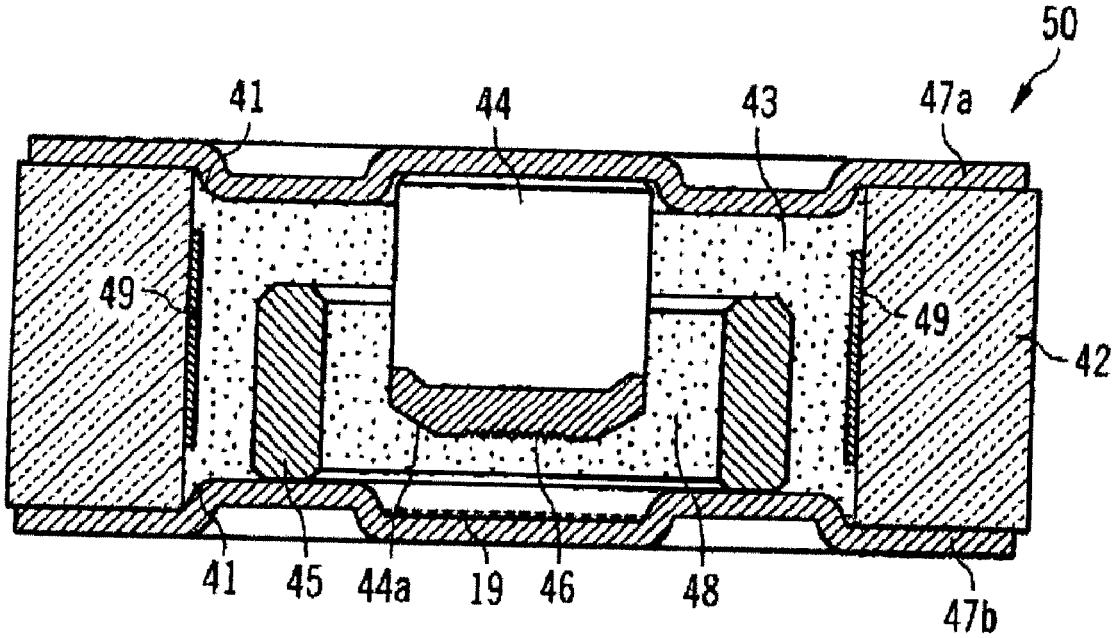
FIG. 4 shows a section through a fourth spark gap.

For low surge current requirements of less than 50 kA, however, the reinforcement electrodes 12*a*, 12*b* can be omitted if the terminal electrodes are correspondingly strengthened—for example, to 1 mm—see also FIG. 4. Copper or an FeNi alloy that is copper-plated before installation is preferably selected as an electrode material. The reliability of the gasproof ceramic-metal bond must be maintained in the design.

The interior 3 of the spark gap is filled with a gas mixture, which preferably contains an argon component of ca. 35 to 95%, a hydrogen component of 5 to 20%, and a neon component of up to 40%. A dynamic ignition voltage and a reliable extinguishing behavior are thereby attained. With this gas mixture, it is possible to reliably establish a static ignition voltage of ca. 600 V with a distance of 2 mm between the rod and the tubular electrode or the width of the discharge space 8.

A discharge through the spark gap typically takes place in the following manner. The current flows from the reinforcement electrode 12*a* and the terminal electrode 7*a* to the rod electrode 4, via the spark discharge of the discharge space 8 to the tubular electrode 5 and to the terminal electrode 7*b*. It leaves the spark gap at the reinforcement electrode 12*b*, in order to be drawn off there, for example, by means of an external conduit. The surge current is mainly discharged radially in the discharge space 8, the insulator 2 being largely shielded from the rod electrode by means of the tubular electrode.

A current flow in the reverse direction is also possible, where current flows via the electrodes 12*b*, 7*b* into the tubular electrode 5; from there to the rod electrode 4 via the discharge space 8; and finally to the electrodes 7*a* and 12*a*.

Figure 2:
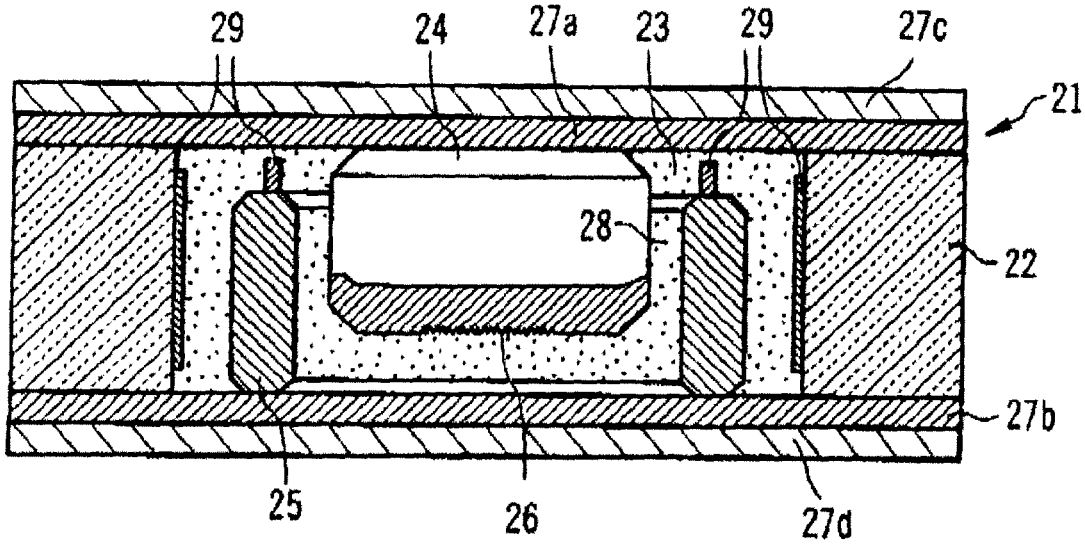
FIG. 2 shows a section through a second spark gap.

FIG. 2 shows another embodiment of a spark gap 21. A rod electrode 24 and a tubular electrode 25, which project or are inserted one into the other and define the main discharge space 28, extend into the cavity 23, which is formed by the insulator 22 and the terminal electrodes 27*a* and 27*b*. An activation composition 26 is placed on the free end of the rod electrode 24—for example, in a waffle-like surface structure. The inside wall of the insulator carries applied ignition lines 29. In a sandwich-like manner, reinforcement electrodes 27*c* or 27*d* are firmly connected to the terminal electrodes 27*a* or 27*b*—for example, by soldering. With regard to the selection of the materials and gases, reference is made to the statements regarding FIG. 1 in order to avoid repetition. The embodiment leads to an extremely compact design with excellent electrical, thermal, and mechanical characteristics.

The embodiment in accordance with FIG. 2 differs from the design in accordance with FIG. 1, on the one hand, in that it has an even smaller structural height. On the other hand, the terminal and reinforcement electrodes are flat and do not have any cavity-side bulges. Overall, the design with a structural height of 10 mm is extremely compact, whereas the diameter of, for example, 30 mm, corresponds to that of FIG. 1. This type of construction is suitable for electrically connecting in series several, specifically 3 or 4, spark gaps. On a power supply of 230 V, without current-limiting components, such as resistors or varistors, it is thus possible to extinguish directly the power supply secondary current in case of a lightning strike. A reduced ignition voltage of approximately 200 V is ensured with a gas mixture of neon-argon-hydrogen ($Ne/Ar/H_2$) in a ratio of 89/1/10 and an electrode spacing 8 of 1 mm.

Figure 3:
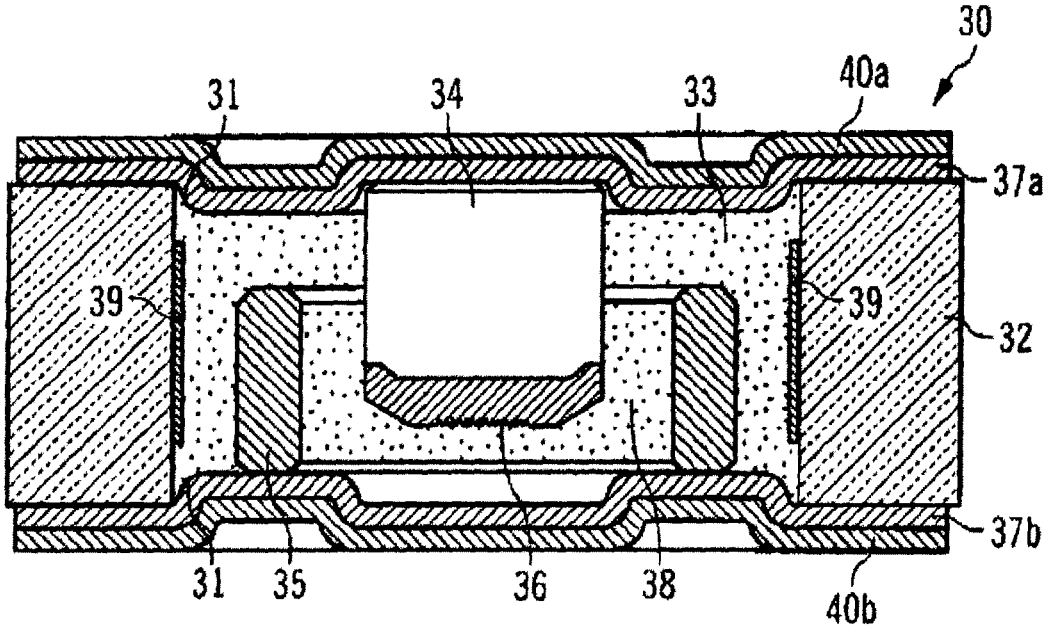
FIG. 3 shows a section through a third spark gap.

FIG. 3 shows an exemplified embodiment with a spark gap 30, in which, as in FIG. 1, the two solution forms are combined. A rod electrode 34 and a tubular electrode 35, which project or are inserted one into the other and define the main discharge space 38, extend into the cavity 33, which is formed by the insulator 32 and the terminal electrodes 37*a*, 37*b*. An activation composition 36 is placed on the free end of the rod electrode 34—for example, in a waffle-like surface structure. The inside wall of the insulator carries applied ignition lines 39, which are largely shaded off from the rod electrode 34 by means of the tubular electrode 35.

The terminal electrodes 37*a*, 37*b* on the front sides of the cylindrical insulator 32 have annular bulges 31 on the outer edge of the cavity 33. Each bulge brings about the guidance of the corresponding terminal electrode relative to the insulator. Alternatively, the bulges can also be shaped in such a way that a number of beads in the bulges of terminal electrodes takes over the guidance. The tubular electrode 35 is welded or soldered to the bulge of the terminal electrode 37*b*, whereas in the central area of the terminal electrode 37*a*, the rod electrode 34 is welded or soldered to it.

In a sandwich-like manner, reinforcement electrodes 40*a* or 40*b* are firmly connected—for example, welded or soldered—to the terminal electrodes 37*a* or 37*b*. Any provided connecting bolts are preferably placed in the bulges of the reinforcement electrodes 40*a*, 40*b*. With regard to the selection of materials and gases, reference is made to the statements regarding FIG. 1 in order to avoid repetition.

The embodiment example effects a very compact spark gap design with optimized characteristics. The electrode materials can meet special requirements and the completed electrodes can be prefabricated. By means of the annular bulge or the beads, a self-adjusted installation or one that is simple to adjust is possible. Other advantages result in the same manner as with the corresponding features of the other figures.

FIG. 4 shows a second solution form of the formulated problem. The spark gap 50 has a cavity 43 that is formed by the insulator 42 and the terminal electrodes 47*a*, 47*b*. A rod electrode 44 and a tubular electrode 45, which project or are inserted one into the other and define the discharge space 48, extend into the cavity 43. An activation composition 46 is placed on the free end of the rod electrode 44—for example, in a waffle-like surface structure. An activation composition 19 is placed on the bottom of the tubular electrode 45. The inside wall of the insulator carries applied ignition lines 29.

The terminal electrodes 47*a* or 47*b* have annular bulges 41. Each bulge brings about the guidance of the corresponding terminal electrode relative to the insulator 42. Alternatively, the bulges can also be shaped in such a way that a number of beads in the bulges of the terminal electrodes takes over the guidance. The tubular electrode 45 is welded or soldered to the bulge of the terminal electrode 47*b*, whereas, in the central area of the terminal electrode 47*a*, the rod electrode 44 is welded or soldered to it.

With regard to the selection of the electrode materials and the gases, reference is made to the statements regarding FIG. 1 in order to avoid repetition. In contrast thereto, the material strength of the terminal electrodes is selected larger and in such a way that the pressures and temperatures appearing during a discharge are reliably controlled. The embodiment leads to an extremely compact design with excellent electrical, thermal, and mechanical characteristics. The functionality of the spark gap corresponds to that of the spark gap shown in FIG. 2. The implementations in accordance with FIG. 2 and FIG. 4 form the two solutions.

Figure 5:
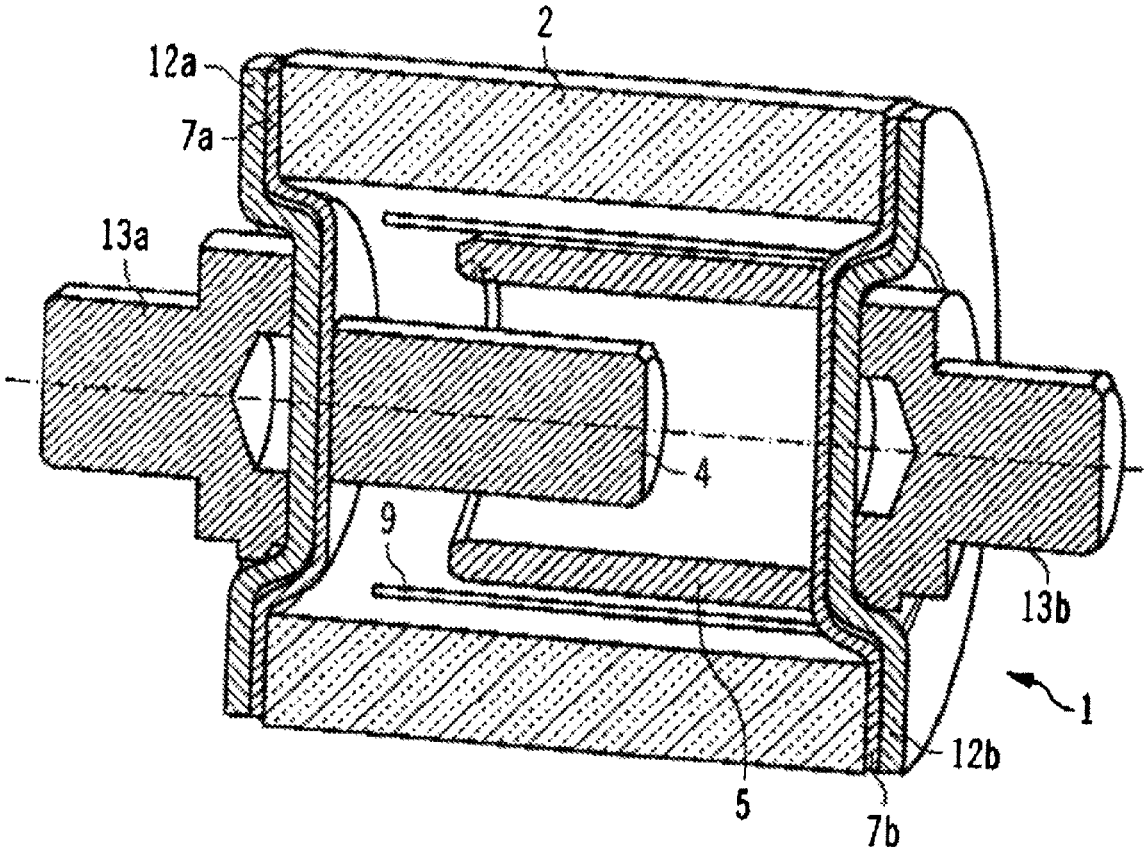
FIG. 5 a three-dimensional view of a spark gap according to FIG. 1, with front-side connecting bolts.

The spark gap in accordance with FIG. 5 is shown in a three-dimensional view. Its construction corresponds to a spark gap in accordance with FIG. 1 and has additional connecting bolts 13*a*, 13*b*. They can be connected directly to either the terminal electrodes 7*a*, 7*b* or to the reinforcement electrodes 12*a*, 12*b*, preferably, in their individual recesses. The connection can be carried out by welding or soldering.

The described spark gaps are preferably used to conduct away direct lightning currents. They can also be used as a device or separation spark gap for protection from corrosion due to gas, water, and oil lines. Furthermore, they can be used as overvoltage arresters for the domestic power system protection.

The spark gaps described herein have a very compact design of, for example, 30 mm in diameter and 30 mm or less in height. They have AC carrying capacities of, for example, 300 A with a duration of 0.2 sec and can ground lightning currents of up to 200 kA. They are suitable for loading with surge current waves with standardized characteristics of 8/20 (build-up time, 8 μsec and time to half-value of 20 μsec) and 10/350. Also, they respond quickly, for example, at a voltage of less than 1500 volts with a rate of rise of ca. 5 kV/μsec, before and after current loads. The static ignition voltage lies, for example, between 600 and 900 V. The spark gaps have a good extinguishing behavior on an AC voltage of 255 V, wherein power supply secondary currents in the range of ca. 100 A can be extinguished reliably after the first half-wave.

The invention claimed is:

1. A spark gap, comprising:

a first terminal electrode and a second terminal electrode on opposing sides of a cavity, the cavity including an electrical discharge space between the first terminal electrode and the second terminal electrode;

an electrical insulator between the first terminal electrode and the second terminal electrode;

wherein:

the first terminal electrode and the second terminal electrode include recesses at a side of the cavity; and the recesses include a plurality of beads that are configured to provide guidance of the first terminal electrode and the second terminal electrode on an inside wall of the insulator.

2. The spark gap of claim 1, further comprising connecting bolts electrically connected to the first terminal electrode and the second terminal electrode.

3. A spark gap, comprising:

a first terminal electrode and a second terminal electrode on opposing sides of a cavity, the cavity including an electrical discharge space between the first terminal electrode and the second terminal electrode;

an electrical insulator between the first terminal electrode and the second terminal electrode, wherein the first terminal electrode and the second terminal electrode include recesses at a side of the cavity, and the recesses include a plurality of beads that are configured to provide guidance of the first terminal electrode and the second terminal electrode on an inside wall of the insulator;

a first reinforcement electrode separate from the first terminal electrode and the second terminal electrode, the first reinforcement electrode having a recess, and the first reinforcement electrode being firmly and electrically being connected to the first terminal electrode; and a second reinforcement electrode separate from the first terminal electrode and the second terminal electrode, the second reinforcement electrode having a recess, and the second reinforcement electrode being firmly and electrically connected to the second terminal electrode.

4. The spark gap of claim 3, wherein the electrical insulator is cylindrical and the terminal electrodes are on each side of the electrical insulator.

5. The spark gap of claim 3, further comprising:

a tubular electrode inside the cavity; and a rod electrode at least partially inside the tubular electrode;

wherein:

the rod electrode is connected to a first terminal electrode of the two terminal electrodes and the tubular electrode is connected to a second terminal electrode of the two terminal electrodes.

6. The spark gap of claim 3, further comprising an ignition aid on an inside surface of the electrical insulator.

7. The spark gap of claim 3, wherein the cavity is hermetically sealed.

8. The spark gap of claim 7, wherein the terminal electrodes are configured to seal the insulator so that the insulator is gasproof.

9. The spark gap of claim 3, further comprising a gas included in the cavity.

10. The spark gap of claim 9, wherein the gas comprises at least one of the following components: between 35% and 95% argon, between 5% and 15% hydrogen, and between 0% and 40% neon.

11. The spark gap of claim 5, wherein the tubular electrode is separated from the electrical insulator.

12. The spark gap of claim 5, wherein an end of the rod electrode and one or more ends of the tubular electrodes inside the cavity are beveled.

13. The spark gap of claim 5, further comprising an activation composition on one or more of the rod electrode and the tubular electrode.

14. A spark gap, comprising:

a first terminal electrode and a second terminal electrode on opposing sides of a cavity, the cavity including an electrical discharge space between the two terminal electrodes;

an electrical insulator between the first and second terminal electrodes;

a first reinforcement electrode separate from the first terminal electrode and firmly connected to the first terminal electrode by welding or soldering on a surface of the first terminal electrode facing away from the cavity; and a second reinforcement electrode separate from the second terminal electrode and firmly connected to the second terminal electrode by welding or soldering on a surface of the second terminal electrode facing away from the cavity.

15. The spark gap of claim 1, further comprising:

a tubular electrode inside the cavity; and a rod electrode at least partially inside the tubular electrode.

16. The spark gap of claim 15, wherein the tubular electrode is welded or soldered to a bulge.

17. The spark gap of claim 15, wherein the rod is connected to one of the first terminal electrode and the second terminal electrode.

18. The spark gap of claim 1, further comprising:

a tubular electrode inside the cavity; and a rod electrode at least partially inside the tubular electrode and welded or soldered to a central area of one of the first terminal electrode and the second terminal electrode.

* * * * *